United States Patent [19]

Marcus et al.

[11] 3,973,466

[45] Aug. 10, 1976

[54] METHOD FOR CHEMILUMINESCENTLY DETECTING INFILTRATION OF PROTECTED PERIMETERS AND THE LIKE

[75] Inventors: Rudolph J. Marcus, Sierra Madre; Eugene E. Gloye, Whittier, both of Calif.

[73] Assignee: The United States of America as represented by the Secretary of the Navy, Washington, D.C.

[22] Filed: Aug. 3, 1973

[21] Appl. No.: 376,069

[52] U.S. Cl. ..... 89/1 A; 252/188.3 CL

[51] Int. Cl.[2] ..... F41F 5/00

[58] Field of Search ..... 89/1 A; 252/188.3 CL

[56] References Cited

UNITED STATES PATENTS

| | | | |
|---|---|---|---|
| 3,753,919 | 8/1973 | Cline | 252/188.3 CL |
| 3,794,022 | 11/1973 | Dubrow et al. | 252/188.3 CL |

*Primary Examiner*—Stephen J. Lechert, Jr.

[57] ABSTRACT

Chemiluminescent materials are encased in a thin, highly frangible shell to form a quantity of microcapsules which, when distributed evenly and in adequate concentration over a perimeter zone, detect infiltration of troops, vehicles, etc., by the chemiluminescence which results from the crushing of the shells. One distribution system uses capsules filled with a chemiluminescent material such as tetrakisdimethylaminoethylene (TMAE). When the capsules are crushed and the contents are exposed to atmospheric oxygen this material oxidizes vigorously to produce a relatively long-lasting chemiluminescence. Another two-component system utilizes capsules containing different chemical components which, when crushed and combined one with the other, produce the chemiliminescence. Both systems employ a shell formed of a film-forming coating material hardenable, into a water-soluble, air tight shell non-reactive with the active filler material.

4 Claims, 3 Drawing Figures

METHOD FOR CHEMILUMINESCENTLY DETECTING INFILTRATION OF PROTECTED PERIMETERS AND THE LIKE

BACKGROUND OF THE INVENTION

The present invention relates to methods for detecting hostile infiltration of protected perimeters and, more particularly to the use of encapsulated chemiluminescent materials to provide the detection capability.

U.S. troops operating in hostile territories such as South Vietnam constantly have been exposed to the risk of being surreptiously infiltrated by the enemy and significant injuries both personnel and equipment have resulted. If these problems are to be avoided, the enemy either must be quickly and positively identified at the moment the crossing or entry is being attempted or they must be readily distinguishable from our own forces once the infiltration has been achieved. This latter need is one that has been particularly apparent in our experiences in South Vietnam where the physical appearance of the enemy is practically indistinguishable from that of our allies.

In other comparable situations there has been a continuing need to detect enemy movements of either troops or equipment along well-known supply trails or across certain zones in which such movements presumably are contrary to mutual agreements. Such movements, of course, are attempted covertly under the cover of darkness so that normal reconnaisance, including aerial reconnaisance, has not been able to provide information that is particularly reliable or useful. Generally, it would be most desirable to provide a means for rendering these movements visually observable not only for intelligence purposes but also to permit the troops or equipment being moved to become immediate targets.

Another significant consideration that is the fact that any intruder who recognizes that he is 'marked' by the luminescence will leave the area as promptly as possible without completing the intended mission. Such a psychological deterrent itself provides a considerable measure of protection.

Due to the seriousness of these and other similar problems, there has been considerable effort devoted to providing the requisite detection capability and various proposals have been attempted with some degree of success. Generally, however, the suggestions have involved relatively expensive and complicated instrumentation not too well suited for use in advance or outpost areas. Further, the proposals do not appear to provide a way of marking the infiltrating enemy or his mobile ordnance equipments so as to permit a ready identification as well as a ready target once they have moved across the protected area.

Although these considerations are of vital concern in military situations they also apply to a number of nonmilitary circumstances. For example, such a detection capability can be used to advantage in crowd-control situations or in other situations where a particular area, building, or even a U.S. border is being protected against surreptitious crossing.

SUMMARY OF THE INVENTION

According to the present invention the desired detection capability can be provided by forming a large quantity of chemiluminescent microcapsules for distribution over the perimeter or area to be protected. Movement of individuals, troops or equipment across this area crushed the microcapsules thereby releasing an active chemiluminescent material which can be detected visually both by the way of the luminescing tracks formed on the terrain as well as the luminescence of the material picked up by the individual or vehicle as the capsules are being crushed. The invention further contemplates particular encapsulation techniques, as well as particular chemiluminescent materials and specific film-forming materials. In general, the film-forming materials are adapted for use with the particular filler material to provide a thin, frangible shell that can isolate and protect the filler until exposed by crushing.

STATEMENT OF THE OBJECTS

A general objective of the present invention is to provide a quantity of microcapsules each filled with an active chemiluminescent material and each encased in a highly-frangible shell capable of being easily crushed by the weight of an individual or other object. A related object is to provide a method of utilizing the chemiluminescence of these capsules to detect hostile infiltrations or other covert movements of mobile equipment or individuals.

Another object is to provide microcapsules having sufficient frangibility to assure crushing under the weight of a normal individual when the microcapsules are resting on a loose bed of sand. At the same time, the capsules must have adequate shell strength to permit transportation, storage and distribution in bulk quantities.

Another object is to provide such microcapsules in a size range of about 2500 microns and an active ingredient content of about 70–75% by weight.

Yet another object is to provide particular chemical formulations both for the active chemiluminescence material and for the shell-forming coating, these formulations permitting the quantities of microcapsules to be formed in a relatively inexpensive, reliable, and simple manner.

A further object is to provide microcapsules having a hardened shell which, in addition to its frangibility, is capable of sealably protecting the active filler material by excluding oxygen, water and other materials capable of deteriorating or otherwise affecting the chemiluminescent capability of the filler.

Still another object is to provide various methods for distributing the chemiluminescent microcapsules, this object as well as others being considered in greater detail in the ensuing description.

BRIEF DESCRIPTION OF THE DRAWINGS

The invention is illustrated in the accompanying drawings of which

DETAILED DESCRIPTION OF THE INVENTION

Figure 1:
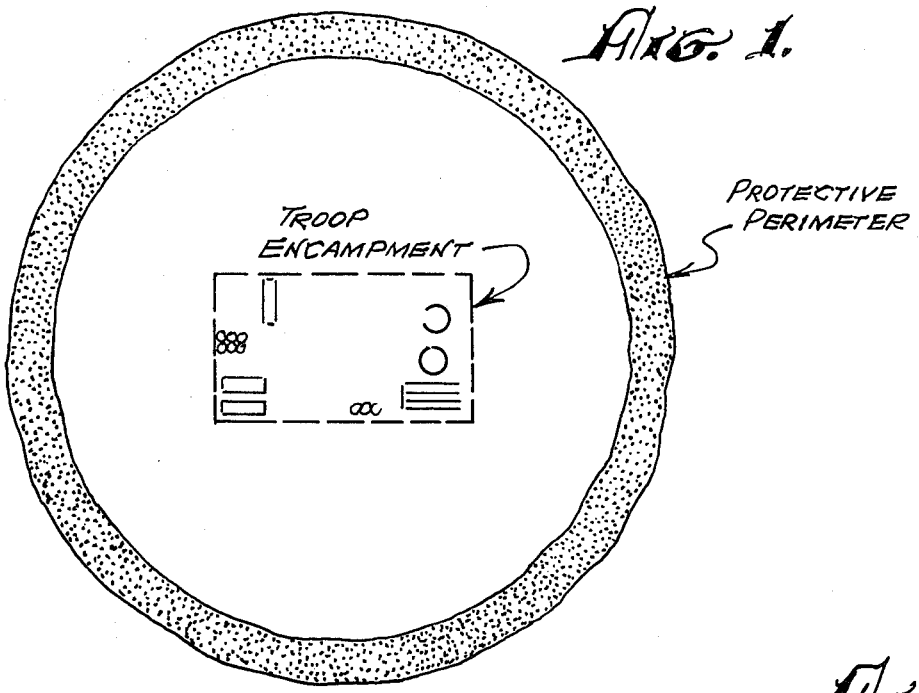
FIG. 1 is a schematic representation of the present detection method.

Referring to the drawings, FIG. 1 illustrates one method of protecting a troop encampment against infiltration of a perimeter zone by an enemy. As shown, the inner block represents a troop encampment composed of troops and equipment located in a front line position surrounded or approximate to enemy territory. Also, surrounding the inner block is a so-called 'Protected Perimeter' which represents an outer limit beyond which any infiltration by the enemy is to be prevented. Customarily this perimeter is protected by some physical barrier such as a mass of barbed wire through which the enemy must crawl in order to infiltrate.

The present method enables the infiltration to be readily detectable by distributing a quantity of microcapsules throughout the protected perimeter zone, these capsules containing an active chemiluminescent material which when released produces a chemiluminescence that can be readily observed. Enemy personnel walking or crawling through the perimeter crush the microcapsules to produce the chemiluminescence.

In another situation, the method also is adapted to detect movement of personnel or equipment along supply trails or over supposedly neutral zones. In the South Vietnam theater of operations, for example, large amounts of equipment were moved undetected along well-known trails at night.

The effectiveness of the method, or, in other words, its detection capability, depends to a considerable extent on the materials used in the microcapsules as well as in the manner which the microcapsules are formed and the manner in which they are distributed. Encapsulation of many liquid, solid or powdered materials is well known. For many years, medicinal capsules have been provided by two-piece hard gelatin shells primarily used for containing liquids or by softer gelatin shells used for containing liquids or pastes. For a number of reasons, these gelatin type capsules are not suitable for the present detection method. Among other things they do not possess the requisite frangibility which assures the crushing and releasing of the active chemiluminescent filler materials and, further, they do not provide adequate environmental protection for these active materials.

Another important consideration involves the basic nature of chemiluminescence which, as is well known, is luminescence produced by a chemical reaction between an active material and another chemical element, material or compound which serves as an excitation source by initiating the chemical reaction. An important class of these active materials are the air-reactive chemiluminescent materials generally characterized by the presence of a structure containing a carbon-carbon double band which has been given a metallic character with nitrogen substituents so as to have a very high oxidation potential. Tetrakisdimethylaminoethylene is an example of such a material as can be seen by its structure:

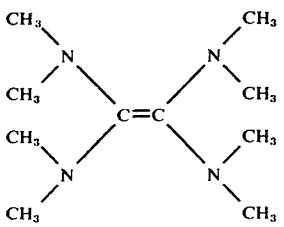

Intermediates produced by the alkaline hydrolysis biisoquinolinium salts are another example. Because these materials vigourously oxidize in air, they obviously must be packaged in a manner that excludes the atmosphere until crushed. Gelatin capsules are not suitable either to seal the material or to permit the desired frangibility.

Further, the shell of the capsules must be of such a nature that the material itself cannot leach through so as to prematurely luminesce and lose its designed efficiency and strengh. Because the present detection method contemplates exposure of the capsule to all atmospheric conditions including wetness, temperature, changes, etc., the mirocapsules must be stable under these conditions. Thus, stability involves not only an initial protective capacity but also an ability to retain this capacity when exposed to the environment. Further, these chemiluminescent capsules must be transported to a location and perhaps stored for relatively long periods of time before being distributed for use. Manifestly, their effectiveness requires a stability capable of retaining the luminescent capability over these relatively long periods of time as such, for example, as a period of 12 or more months.

To assure that the conditions which have been described are met, the present capsules, as already indicated, are formed in a particular manner from particular materials. First, with regard to the manner in which the microcapsules are formed, the objectives are to provide very small capsules, within a size range of about 2500 microns or smaller, the capsules carrying a high payload in spite of the relatively small size. Thus, for example, microcapsules suitable for the present detection method should have an active ingredient content of about 70–75% by total weight. To achieve these results, the present method contemplates the use of known encapsulation techniques and equipment. One simple but effective way of performing the encapsulation is to use a conventional Spraying Systems Number 2050 fluid nozzle having an 0.020 mil orifice, the nozzle being mounted in a vertically downward position to permit capsules formed at the orifice of the nozzle to drop by gravity to a hardening bath. Using this arrangement, a chemically active material can be pumped by a syringe pump through the 0.020 mil orifice while the shell solution is pumped by an air pump through the air ports of the nozzle. The result is the formation of a liquid rod of the active filler material encased in the sheath of the shell solution. After the compounded rod leaves the nozzle, it breaks into capsules under the force of gravity and the capsules are caught in the hardening bath. Flow rates for the active filler material and the shell solution can be about 5.2 grams per minute and 26 grams per minute, respectively. A suitable hardening bath can be formed of an aqueous solution containing 5% by weight calcium chloride, 1% by weight sodium borate and 0.2% by weight Tergitol PMN (a non-ionic surfactant). The capsules are periodically removed from the hardening bath and allowed to air dry overnight on a cloth.

Figure 3:
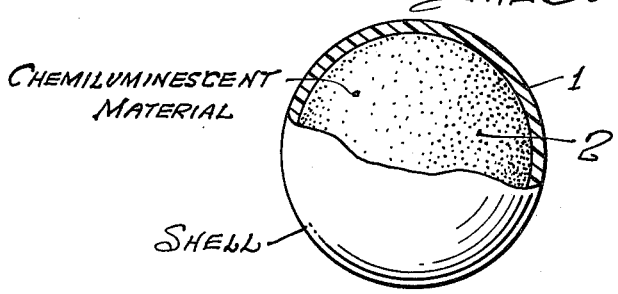
Figure 2:
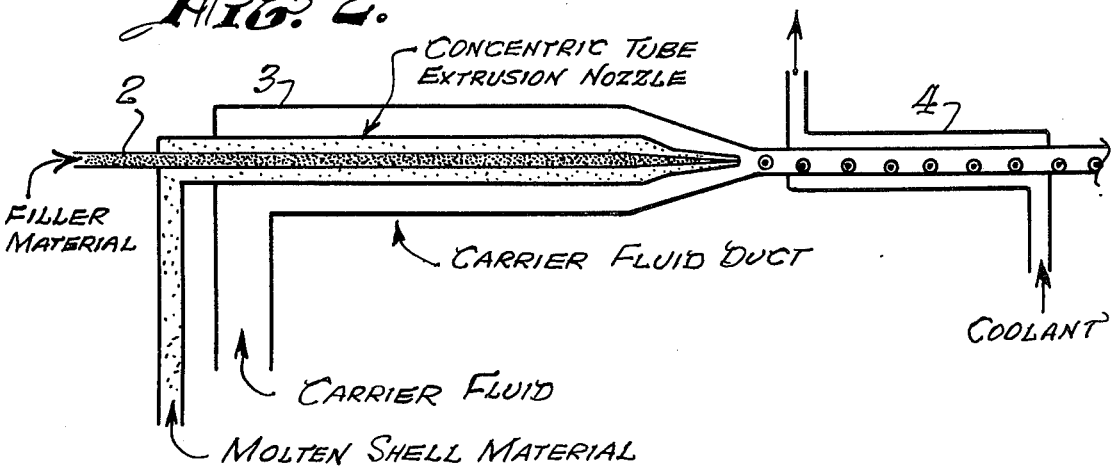
FIG. 2 is another schematic showing prior art apparatus used for the forming the microcapsules used in the present invention and, FIG. 3 is an enlarged, cross-sectional view of one of the microcapsules.

Another perhaps more efficient manner of forming the capsules is described in U.S. Pat. No. 3,389,194. This patent discloses a special encapsulating apparatus similar to that illustrated in FIG. 3 of the present drawings. As shown in FIG. 3, a hot-melt shell material is pumped through the annulus of an extrusion nozzle 1 and the active filler material also is pumped through a center tube 2 of the nozzle so as to form a fluid rod of filler material encased in a sheath of shell material, the rod then being broken into individual capsules in a carrier fluid stream supplied through a concentric tube 3. Capsule hardening then is accomplished by cooling the carrier fluid in a heat exchanger 4. The advantage of an arrangement of this type is that it incorporates the moving fluid carrier which is capable of influencing capsule size and of providing an effective method of handling the freshly formed capsules. Other suitable encapsulating processes and apparatus for the continuing production of seamless spherical capsules of controlled characteristics are shown in U.S. Pat. Nos. 2,766,478 and 3,015,128. In general, these methods have in common the concept of supplying the active filler material to a sheath or membrane of a film-forming, liquid, shell material and then utilizing gravity or other means, such as the moving fluid carrier, to overcome the cohesive force of the shell membrane material and permit the capsules to break loose. As the capsules break loose the shell membrane material reforms to encase succeeding supplies of the active filler material.

The resulting microcapsules are, as indicated, seamless, spherical capsules the size of which can be controlled in the manners which aleady have been considered. In addition, the wall thickness of the capsules can be controlled to assure that a chemical stability-frangibility relationship is established, and to assure a high pay-load relative to the small size. Stability, of course, involves the abiity of mirocapsules to resist crushing or physical deterioration when stored for relatively long periods of time or transported in bulk quantities. Frangibility is a factor which will depend primariy upon the specific use for which the capsules are intended. For example, if used to detect individuals infiltrating through a perimeter zone, the frangibility must be such that the capsules will be crushed when resting on a bed of loose sand and when subjected to the weight of an average individual.

The particular formulations used for forming the shell material as well as the active filler material can be varied to considerable degrees, although, in every instance, there must be a compatibility between the filler and the shell to the extent that the shell must be immiscible and non-reactive with the filler and its physical structure must be such that the filler cannot leach or leak outwardly through it. One particularly useful filler material which already has been mentioned is tetrakis-dimethylaminoethylene, a product made by DuPont known in the art as TMAE. Other similar chemiluminescent materials having the nitrogen-substituted, double bond carbon arrangement also can be used.

Of the various shell combinations used for the TMAE, the two best formulations were 1. 1.0 wt % LVA 10 Algin (sodium alginate)
   8.0 wt % Elvanol 100-30 poly(vinyl alcohol)
   90.8 wt % Distilled water
   0.2 wt % Tergitol TMN
2. 8.0 wt % Elvanol 100-30
   1.0 wt % LVA-10 Algin
   9.0 wt % Distilled water
   0.2 wt % Tergitol TMN
   0.8 wt % Parez Resin 613 (melamine-formaldehyde)

In formulation (2) the Parez Resin apparently cross-links the polyvinyl alcohol and it is believed that this material improves the shell formation and prolongs the life of the microcapsules.

Products using these two formulations were formed employing the Spraying Systems fluid nozzle apparatus that previously has been described. In particular, the TMAE was pumped by this syringe pump through the nozzle orifice and the shell solution of the formulations pumped by a gear box through the air ports of the nozzle. The resulting liquid rod of TMAE thus was fed into the film-forming shell solution to encase the rod in a sheath or membrane and after the rod frees itself from the nozzle it breaks into capsules under the force of gravity. The capsule size was approximately 2500 microns and the active ingredient content of the capsules was 70–75% by weight.

Tests using capsules formed in this manner showed that, when the capsules were stored under nitrogen they tended to sweat and agglomerate. However, storage in vials containing air prevented th sweating and the capsules appeared to be stable indefinitely. Based upon this sweating phenomenon, it appears that the hardened shell of the capsules may leak a small amount but that, in the presence of air, such leaks are absolutely stopped by reaction products. Substantiation of this possible explanation also is the fact that a slight initial glow was noted when the capsules first were exposed to air. It thus appears likely that the TMAE filler compound is capable of leaching into the hardened shell of the capsule where, in the presence of air, the compound reacts to provide an air-tight seal that subsequently protects the filler. Capsules formed in this manner have retained their high-strength chemiluminescence for periods of up to two years when stored in open air. Physically considered, some of the TMAE capsules appeared almost colorless while others had an orange color. This coloration apparently is due to a pH effect in which a low pH value causes the color to be light while high pH values turn the capsules orange. However, there appeared to be no difference in activity between the orange and the colorless capsules.

Tests on the TMAE capsules having demonstrate their usefulness in chemiluminescent detection. In other words, these capsules have the frangibility, stability, strength and chemiluminescent efficiency to permit a ready detection of individuals or objects moving over them. Specifically, the capsules glow visibly when crushed and exposed to the oxygen of the atmosphere which, of course, is the element that reacts with the TMAE to produce the luminescence. The glow lasts about 15 minutes and is renewed by additional mashing and mixing when subjected to additional steps or body movements of simulated infiltrators. Further, the glow is readily visible at about 100 yards in half moonlight. Of equal importance, the capsules have adequate strength in spite of their extreme frangibility to survive bulk transportation and storage without being prematurely and accidently crushed and the shells in addition to being air-tight are water-tight. No reactions between the TMAE and the shell were noted other than the fact that the TMAE initially may permeate slightly into the shell where it initially forms reaction products with the air to assure an air seal. In using microcapsules of this type to protect, for example, the perimeter of FIG. 1, the microcapsules simply are distributed evenly over the perimeter area, using as example a concentration of about one capsule per square inch. The distribution cost is estimated to be about $100 for about 1000 square feet, although this estimate is based strictly upon laboratory costs rather than production run costs. Other estimates indicate that these costs could be reduced by a factor of 10 if the capsules were produced in large quantities.

Although the microcapsules formed in the previously-described manner from the previously-identified materials are present preferred, other active filler materials and other shell formulations also may be used and, for some purposes, may be more desirable. One particular modification of the TMAE capsules involves what can be referred to as a two-component detection or binary capability. Thus, instead of using an oxygen-active filler material, capsules can be formed using an oxalate ester - hydrogen peroxide - fluorescer system. To adapt these materials for the desired capability, a quantity of microcapsules are formed but, instead of having all of the capsules identical one with the other, one half of the capsules will be formed using hydrogen peroxide as a filler and the other half having the oxalate ester - fluorescer mixture as the active filler material. Before distributing these differing microcapsules over the area to be protected, the individual halves are mixed together so that, theoretically, distribution provides a microcapsule of one type in close proximity to a microcapsule of another type. Obviously, an individual stepping on the protected are crushes both of the microcapsules simultaneously so as to expose the one filler compound with the other and permit the chemical reaction that produces the desired luminescence. Alternatively, the different halves of the quantity can be distributed in, for example, a radially-spaced disposition to provide a 'two-stage' process. In the first stage, an individual first crushes one type of capsule and in the second, the filler material is carried by the individual to the next stage in where the other type of capsule is crushed to promote the chemical reaction and the desired luminescence. Shell materials for use in the two-component process can be formulated in a manner similar to that previously described, although selection of the materials must assure that the shell is immiscible and unreactive with the particular filler material as well as being air-tight and water-tight.

Other manners of distributing the capsules and of utilizing the luminescence resulting from the crushing will be dictated by particular needs or the particular situations that are confronted. Military needs are the most obvious and, as has been stated, the present capsules when distributed in the manners that have been described, appear well-suited for these purposes. However, important non-military needs also are contemplated. Further, as will be appreciated, the present teachings provide an excellent packaging technique for TMAE or the like regardless of the use to which the capsules may be put.

Obviously many modifications and variations of the present invention are possible in the light of the above teachings. It is therefore to be understood that within the scope of the appended claims the invention may be practiced otherwise than as specifically described.

We claim:

1. A method of detecting movements of particular objects across a particular area comprising:

forming a quantity of chemiluminescent microcapsules by encapsulating minute droplets formed entirely of chemiluminescent filler compounds in a film-forming coating material of a type that is hardenable in situ into a water-insoluble air-tight impermeable and seamless shell immiscible and non-reactive with said filler compound, and distributing said quantity of microcapsules evenly over said area in sufficient concentration to assure contact with said objects as they move across the area, said shell frangibility being such that said contact crushes the shells for exposing said filler compounds and permitting said compounds to chemiluminesce whereby said movements can be observed.

2. The method of claim 1 wherein said filler compound is an oxygen-activated chemiluminescent material and said crushing produces said luminescence by exposing said material to environmental oxygen.

3. The method of claim 1 where said quantity of microcapsules is provided by separate and distinct batches each of which is formed of a shell and of a different filler compound, the filler compound of one batch being chemically reactive with the filler compound of the other batch, said detection is achieved by crushing both of said batches to expose one of said filler compounds for chemical reaction with the other.

4. The method of claim 3 wherein said separate batches are evenly mixed one with the other and distributed over said area in said evenly-mixed disposition.

* * * * *